US005226773A

United States Patent [19]

Morito et al.

[11] Patent Number: 5,226,773

[45] Date of Patent: Jul. 13, 1993

[54] APPARATUS FOR STOWING PALLET MOUNTED WITH CARGO INTO HOLD OF FREIGHT VESSEL

[75] Inventors: Hisatomo Morito; Goichi Sekiguchi, both of Tokyo, Japan

[73] Assignees: NKK Corporation; MacGregor-Navire (Kayaba), Ltd., both of Tokyo, Japan

[21] Appl. No.: 917,594

[22] Filed: Jul. 23, 1992

[30] Foreign Application Priority Data

Aug. 21, 1991 [JP] Japan ..... 3-234161

[51] Int. Cl.[5] ..... B63B 27/00

[52] U.S. Cl. ..... 414/137.1; 414/495; 198/468.6; 198/774.2

[58] Field of Search ..... 164/48, 129, 199; 198/468.6, 774.2; 414/143.2, 137.1, 495, 498

[56] References Cited

U.S. PATENT DOCUMENTS

| | | | |
|---|---|---|---|
| 3,369,684 | 2/1968 | Ford | 414/498 |
| 4,042,118 | 8/1977 | Schmidt | 198/468.1 |
| 4,353,457 | 10/1982 | Haley | 414/495 |
| 4,459,078 | 7/1984 | Chiantella et al. | 414/495 |
| 4,553,896 | 11/1985 | Yoshida | 414/495 |

FOREIGN PATENT DOCUMENTS 3-159897 7/1991 Japan .

*Primary Examiner*—H. Grant Skaggs

*Attorney, Agent, or Firm*—Frishauf, Holtz, Goodman & Woodward

[57] ABSTRACT

An apparatus for stowing a pallet mounted with a cargo into a hold of a freight vessel, which comprises: two pairs of rails installed on a floor of a hold of a freight vessel in parallel with the center line of the freight vessel; at least two rows of pallet stands, for placing a pallet mounted with a cargo, provided at least outside each of the two pairs of rails; two carriages travellable on the two pairs of rails in synchronization with each other, a vertically moveble table provided each carriage; and a lifting mechanism of the table. The above-mentioned lifting mechanism comprises an outer cylinder fixed vertically on each carriage, an inner cylinder slidably engaging in the outer cylinder, a disk fixed to the upper end of the inner cylinder and connected to the table, and a hydraulic means comprising a cylinder pin-connected vertically to each carriage and a rod engaging in the cylinder, the upper end of the rod of the hydraulic means being pin-connected to the center of the lower surface of the disk, whereby the table is vertically movable by means of the hydraulic means and rotatable in a horizontal plane.

10 Claims, 6 Drawing Sheets

PRIOR ART

APPARATUS FOR STOWING PALLET MOUNTED WITH CARGO INTO HOLD OF FREIGHT VESSEL

REFERENCE TO PATENTS, APPLICATIONS AND PUBLICATIONS PERTINENT TO THE INVENTION

As far as we know, there is available the following prior art document pertinent to the present invention:

(1) Japanese Patent Provisional Publication No. 3-159,897 dated Jul. 9, 1991.

The contents of the prior art disclosed in the above-mentioned prior art document will be discussed hereafter under the heading of the "BACKGROUND OF THE INVENTION."

BACKGROUND OF THE INVENTION

Field of the Invention

The present invention relates to an apparatus for stowing a pallet mounted with a cargo into a hold of a freight vessel.

Related Art Statement

As an apparatus for stowing a cargo such as a steel strip coil into a hold of a freight vessel, Japanese Patent Provisional Publication No. 3-159,897 dated Jul. 9, 1991 discloses an apparatus for stowing a pallet mounted with a cargo into a hold of a freight vessel, which comprises:

two pairs of rails installed on a floor of a hold of a freight vessel symmetrically relative to the center line of said freight vessel and in parallel with said center line;

at least two rows of pallet stands, for placing a pallet mounted with a cargo, provided at least outside each of said two pairs of rails and in parallel therewith;

two carriages travellable on said two pairs of rails in synchronization with each other, said two carriages being arranged each on each of said two pairs of rails:

a vertically movable table provided on each of said two carriages; and a lifting mechanism of said table, provided on each of said two carriages (hereinafter referred to as the "prior art").

FIG. 6 is a schematic plan view illustrating a typical apparatus of the above-mentioned prior art. As shown in FIG. 6, two pairs of rails 1, 1' are installed on a floor o a hold of a freight vessel symmetrically relative to the center line of the freight vessel and in parallel with the center line. Three rows of pallet stands 5 for placing a pallet 4 mounted with a cargo, are provided in parallel with the two pairs of rails 1, 1' outside each of the two pairs of rails 1, 1' and between the two pairs of rails 1, 1'.

Two carriages 2, 2' travellable on the two pairs of rails in synchronization with each other, are arranged each on each of the two pairs of rails 1, 1'. Each of the two carriages 2, 2' is provided with a vertically movable table 3 having a rectangular plane shape and a lifting mechanism of the table 3.

The lifting mechanism of the table 3 comprises four hydraulic means 22 each comprising a cylinder fixed vertically to each of the two carriages 2, 2' and a rod engaging in the cylinder. Each of the four hydraulic means 22 is arranged between each of the two carriages 2, 2' and the table 3, at each of the four corners of the lower surface of the table 3, and the upper end of the rod of each of the four hydraulic means 22 is secured to each of the four corners of the lower surface of the table 3, whereby the table 3 is vertically movable by the operation of the four hydraulic means 22.

The two carriages 2, 2' on the two pairs of rails 1, 1' are positioned at a starting point of travel under a hatch not shown. Then, the table 3 provided on each of the two carriages 2, 2' is lifted by means of the four hydraulic means 22 to a prescribed position above the upper surface of the pallet stand 5. Then, the pallet 4 mounted with a cargo is hung and lowered by means of a crane or the like from the hatch not shown into the hold, and is placed on over both of the tables 3, 3 of the two carriages 2, 2' at right angles to the travelling direction thereof.

Then, the two carriages 2, 2' are caused to travel in synchronization with each other toward a prescribed stowage position on the pallet stands 5. Each of the tables 3, 3 of the two carriages 2, 2' are then lowered by means of the four hydraulic means 22 to place the pallet 4 on the tables 3, 3 onto the prescribed stowage position on the pallet stands 5, and the pallet 4 is secured by means of a rope or the like to a securing fitting not shown provided at the stowage position. The pallet 4 mounted with the cargo is thus stowed at the prescribed stowage position on the pallet stands 5 and secured there.

Then, each of the tables 3, 3 is lifted by means of the four hydraulic means 22 provided on each of the two carriages 2, 2' to a prescribed position above the upper surface of the pallet stands 5, and then, the two carriages 2, 2' are returned to the above-mentioned starting point of travel under the hatch. The above-mentioned operations are sequentially repeated. A plurality of pallets 4 mounted with cargoes are thus sequentially stowed at the prescribed stowage position on the pallet stands 5 in the hold.

The above-mentioned prior art has the following problems:

(1) In order to efficiently stow a plurality of pallets 4 mounted with cargoes at a prescribed stowage position on the pallet stands 5 in the hold, it is necessary to place the plurality of pallets 4 on the pallet stands 5 at right angles to the longitudinal direction thereof in parallel with each other. However, when hanging and lowering the pallet 4 mounted with the cargo by means of a crane or the like from the hatch not shown onto the tables 3, 3 of the two carriages 2, 2' in the hold, the lowered pallet 4 is not always placed on the tables 3, 3 at right angles to the travelling direction of the two carriages 2, 2'. As indicated by a one-point chain line in FIG. 6, the pallet 4 may sometimes be placed on the tables 3, 3 at a drift angle to the travelling direction of the two carriages 2, 2'.

In the case where the pallet 4 is placed on the tables 3, 3 at a drift angle to the travelling direction of the two carriages 2, 2', the pallet 4 would be placed, as indicated by a one-point chain line in FIG. 6, on the pallet stands 5 at the drift angle to the longitudinal direction thereof. As a result, the plurality of pallets 4 mounted with the cargoes cannot be efficiently stowed onto the pallet stands 5, leading to a decreased quantity of pallets stowed onto the pallet stands 5.

When the pallet 4 is placed on the pallet stands 5 at a drift angle to the longitudinal direction thereof, furthermore, the pallet 4 may be deviated from the securing fitting provided at the prescribed stowage position on the pallet stands 5, thus making it impossible to certainly secure the pallet 4 to the securing fitting by means of a rope or the like.

(2) When the two carriages 2, 2', with the pallet 4 placed on over both of the tables 3, 3 thereof, travels toward the prescribed stowage position on the pallet stands 5, a difference may sometimes be produced in the travelling speed between the two carriages 2, 2'. If a difference in the travelling speed between the two carriages 2, 2' causes a difference in the relative position in the travelling direction between the two carriages 2, 2', then torsion or other excessive stress would act on the two carriages, thus resulting in easy breakage of the two carriages 2, 2'.

(3) When the cargo mounted on the pallet 4 is considerably heavy in weight, deflection may be produced in the pallet 4 placed on over both of the tables 3, 3 of the two carriages 2, 2'. The production of such deflection in the pallet 4 results in partial concentration of load on the tables 3, 3, and hence in easier breakage of the tables 3, 3.

Under such circumstances, there is a strong demand for the development of an apparatus which, when stowing a pallet mounted with a cargo into a hold of a freight vessel by means of two carriages, permits to place the pallet at a prescribed stowage position on the pallet stands at right angles to the longitudinal direction thereof so as to efficiently stow a plurality of pallets at the prescribed stowage position on the pallet stands, even if the pallet is placed on the tables of the two carriages at a drift angle to the travelling direction thereof, and furthermore, prevents breakage of the two carriages caused by torsion or other excessive stress acting on the two carriages, even if a difference is produced in a relative position of the two carriages in the travelling direction thereof, but such an apparatus has not as yet been proposed.

SUMMARY OF THE INVENTION

An object of the present invention is therefore to provide an apparatus which, when stowing a pallet mounted with a cargo into a hold of a freight vessel by means of two carriages, permits to place the pallet at a prescribed stowage position on the pallet stands at right angles to the longitudinal direction thereof so as to efficiently stow a plurality of pallets at the prescribed stowage position on the pallet stands, even if the pallet is placed on the tables of the two carriages at a drift angle to the travelling direction thereof, and furthermore, prevents breakage of the two carriages caused by torsion or other excessive stress acting on the two carriages, even if a difference is produced in a relative position of the two carriages in the travelling direction thereof.

In accordance with one of the features of the present invention, there is provided an apparatus for stowing a pallet mounted with a cargo into a hold of a freight vessel, which comprises:

two pairs of rails (1, 1') installed on a floor of a hold of a freight vessel symmetrically relative to the center line of said freight vessel and in parallel with said center line;

at least two rows o pallet stands (5), for placing a pallet (4) mounted with a cargo, provided at least outside each of said two pairs of rails (1, 1') and in parallel therewith;

two carriages (2, 2') travellable on said two pairs of rails (1, 1') in synchronization with each other, said two carriages (2, 2') being arranged each on each of said two pairs of rails (1, 1');

a vertically movable table (3) provided on each of said two carriages (2, 2'); and a lifting mechanism of said table (3), provided on each of said two carriages (2, 2'), said lifting mechanism comprising an outer cylinder (8) fixed vertically on each of said carriages (2, 2'), an inner cylinder (13) slidably engaging in said outer cylinder (8), a disk (10) fixed to the upper end of said inner cylinder (13), said disk (10) being connected to said table (3), and a hydraulic means (9) comprising a cylinder (9*a*) pin-connected vertically to each of said carriages (2, 2') and a rod (9*b*) engaging in said cylinder (9*a*), the upper end of said rod (9*b*) of said hydraulic means (9) being pin-connected to the center of the lower surface of said disk (10), whereby said table (3) is vertically movable by means of said hydraulic means (9) and rotatable in a horizontal plane.

DETAILED DESCRIPTION OF THE PREFERRED EMBODIMENTS

From the above-mentioned point of view, extensive studies were carried out to develop an apparatus which, when stowing a pallet mounted with a cargo into a hold of a freight vessel by means of two carriages, permits to place the pallet at a prescribed stowage position on the pallet stands at right angles to the longitudinal direction thereof so as to efficiently stow a plurality of pallets at the prescribed stowage position on the pallet stands, even if the pallet is placed on the tables Of the two carriages at a drift angle to the travelling direction thereof, and furthermore, prevents breakage of the two carriages caused by torsion or other excessive stress acting on the two carriages, even if a difference is produced in a relative position of the two carriages in the travelling direction thereof.

As a result, the following findings were obtained: a lifting mechanism of a table provided on each of the two carriages is configured from an outer cylinder fixed vertically on each of the two carriages, an inner cylinder slidably engaging in the outer cylinder, a disk fixed to the upper end of the inner cylinder and connected to the lower surface of the table, and a hydraulic means comprising a cylinder pin-connected vertically each of the two carriage and a rod engaging in the cylinder, and the upper end of the rod of the hydraulic means is pin-connected to the center of the lower surface of the disk to make the table vertically movable and rotatable in a horizontal plane. In this configuration, it is possible to position the pallet on the tables of the two carriages at right angles to the travelling direction thereof, by correcting a relative position of the two carriages in the travelling direction thereof, even if the pallet is placed on the tables of the two carriages at a drift angle to the travelling direction thereof, and therefore, it is possible to place the pallet at a prescribed stowage position on the pallet stands at right angles to the longitudinal direction thereof. In addition, since the tables of the two carriages, on which the pallet is placed, are rotatable in a horizontal plane, torsion or other excessive stress never acts on the two carriages, even if a difference is produced in a relative position of the two carriages in the travelling direction thereof.

The present invention was made on the basis of the above-mentioned findings. Now, the apparatus of the present invention is described below with reference to the drawings.

Figure 1:
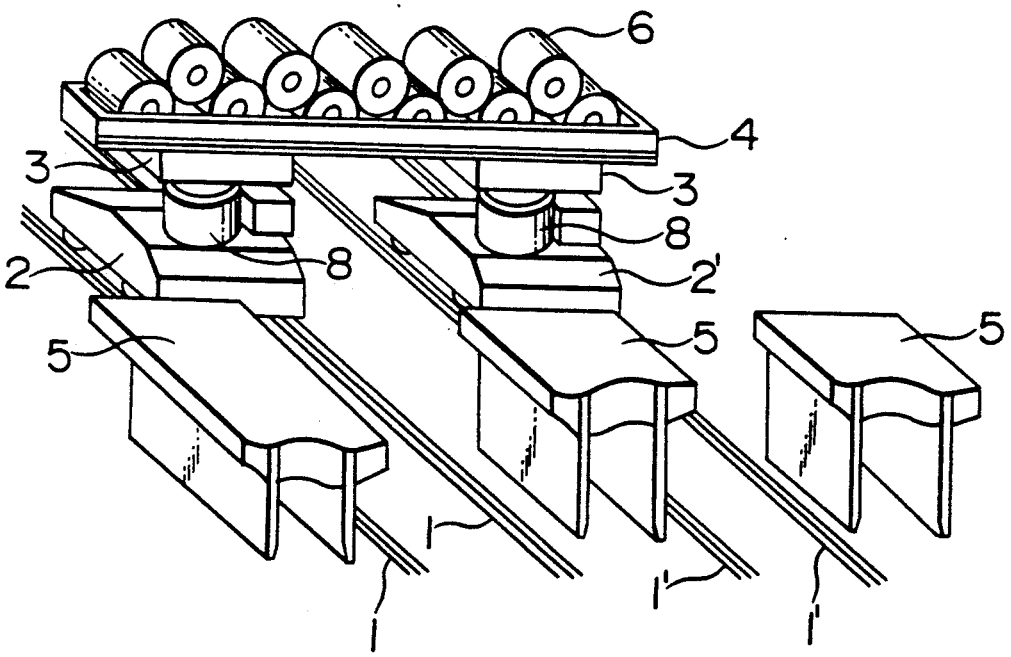
FIG. 1 is a schematic perspective view illustrative an embodiment of the apparatus of the present invention.
Figure 2:
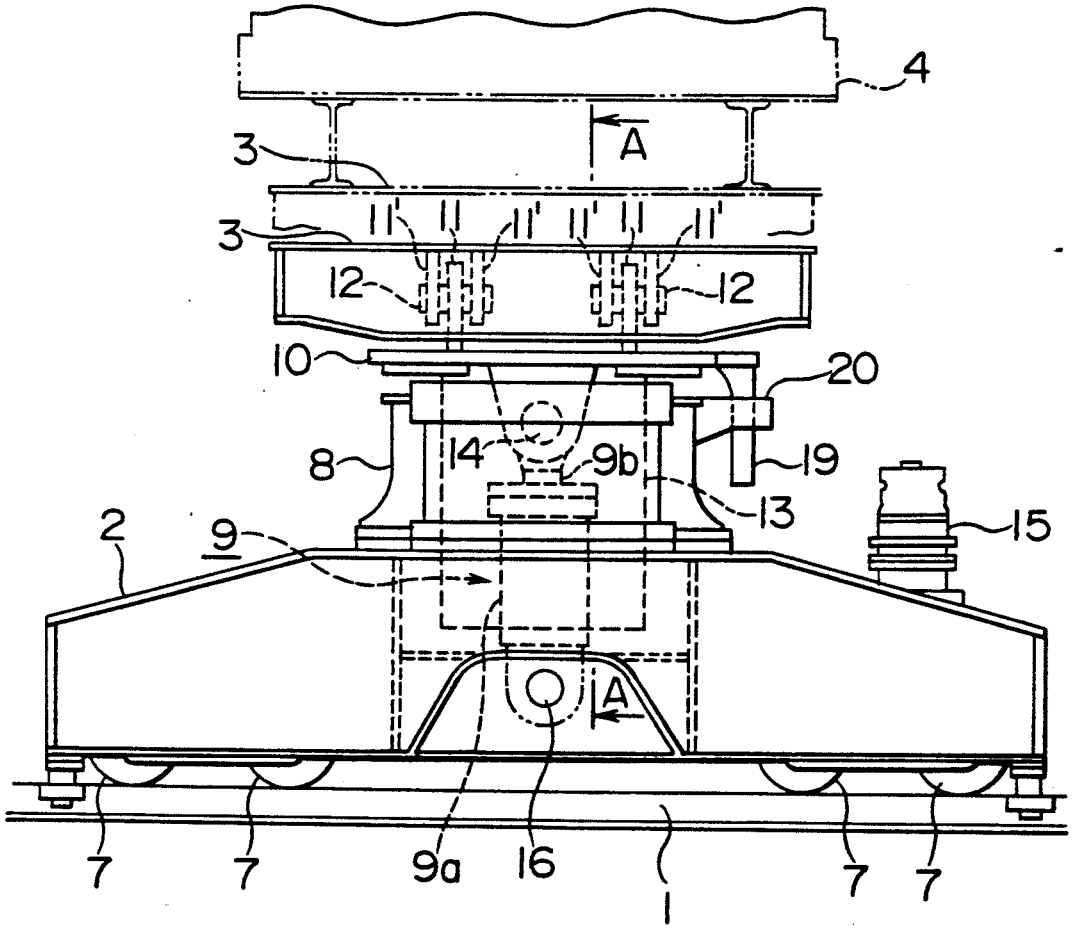
FIG. 2 is a schematic side view illustrating the state of a table of a carriage of the present invention when the table is at the lowermost and the uppermost positions thereof.
Figure 3:
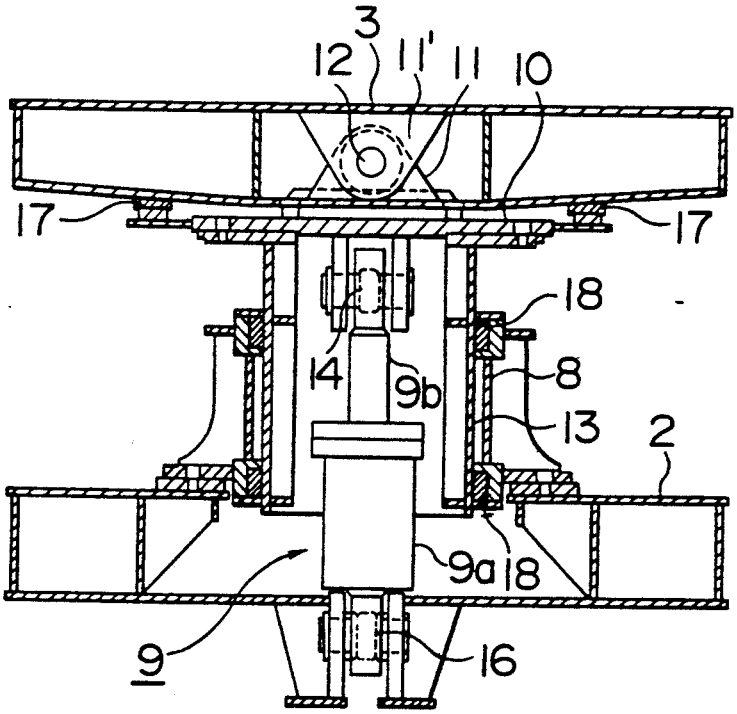
FIG. 3 is a sectional view, cut along the line A—A in FIG. 2, illustrating the state of the table of the carriage at the uppermost position the FIG. 4 is an enlarged schematic plan view illustrating a disk rotation limiting mechanism of the apparatus of the present invention.
Figure 4:
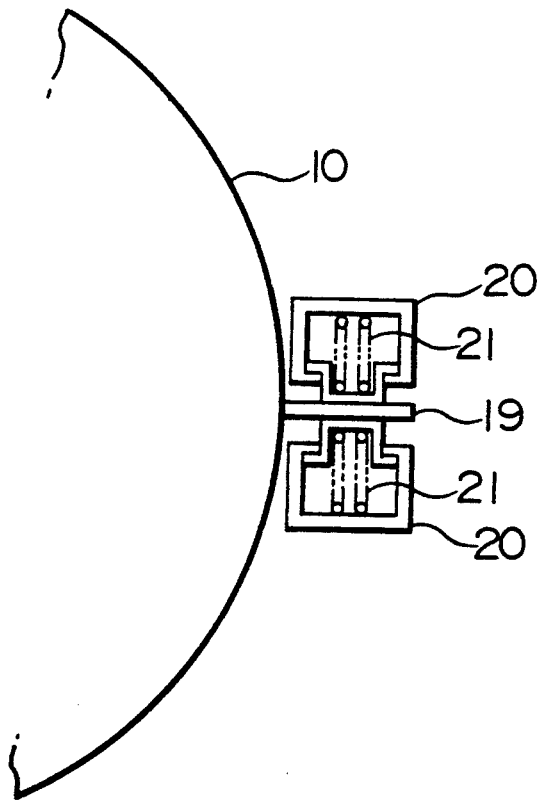

FIG. 1 is a schematic perspective view illustrating an embodiment of the apparatus of the present invention; FIG. 2 is a schematic side view illustrating the state of a table of a carriage of the present invention when the table is at the lowermost and the uppermost positions thereof; FIG. 3 is a sectional view, cut along the line A—A in FIG. 2, illustrating the state of the table of the carriage at the uppermost position thereof; and FIG. 4 is an enlarged schematic plan view illustrating a disk rotation limiting mechanism of the apparatus of the present invention.

As shown in FIG. 1, in the apparatus of the present invention, as in the apparatus of the prior art, two pairs of rails 1, 1' are installed on a floor of a hold of a freight vessel symmetrically relative to the center line of the freight vessel and in parallel therewith. At least two rows of pallet stands 5 for placing a pallet 4 mounted with a cargo 6 are provided at least outside each of the two pairs of rails 1, 1' and in parallel therewith. Two carriages 2, 2' travellable in synchronization with each other are arranged each on each of the two pairs of rails 1, 1'. Each of the two carriages 2, 2' is provided with a vertically movable table 3 and a lifting mechanism for the table 3. In the embodiment shown in FIG. 1, three rows of pallet stands 5 are provided in parallel with the two pairs of rails 1, 1' outside each of the two pairs of rails 1, 1' and between the two pairs of rails 1, 1', whereas two rows of pallet stands 5 may be provided outside each of the two pairs of rails 1, 1'.

Now, the structure of the two carriages 2, 2' is described for one carriage 2. As shown in FIGS. 2 and 3, the carriage 2 travels by means of wheels 7 on the rail 1. In FIGS. 2 and 3, 15 is a driving motor for the carriage 2. The carriage 2 is provided with a table 3 and a lifting mechanism for the table 3.

The lifting mechanism for the table 3 comprises an outer cylinder 8 fixed vertically on the carriage 2, an inner cylinder 13 slidably engaging in the outer cylinder 8, a disk 10 fixed to the upper end of the inner cylinder 13 and connected to the lower surface of the table 3, and a hydraulic means 9 comprising a cylinder 9*a* pin-connected vertically to the carriage 2 and a rod 9*b* engaging in the cylinder 9*a*.

The lower end of the cylinder 9*a* of the hydraulic means 9 is pin-connected through a spherical bearing 16 to the carriage 2. The upper end of the rod 9*b* of the hydraulic means 9 is pin-connected through another spherical bearing 14 to the center of the lower surface of the disk 10. The table 3 is thus vertically movable by means of the hydraulic means 9 together with the disk 10 and the inner cylinder 13, and is rotatable in a horizontal plane. A bush 18, which is in contact with the outer circumferential surface of the inner cylinder 13 slidably engaging in the outer cylinder 8, is provided on the inner circumferential surface of each of the upper and the lower portions of the outer cylinder 8.

The disk 10 is connected to the lower surface of the table 3 at two points at a prescribed interval therebetween by means of two pins 12, 12 paralleling with the travelling direction of the carriage 2, each inserted into each of two sets of a connecting fitting 11 fixed to the upper surface of the disk 10 and another connecting fitting 11' fixed to the lower surface of the table 3. By thus connecting the disk 10 to the table 3 at two points by means of the two pins 12, 12 paralleling with the travelling direction of the carriage 2, it is possible to tilt the table 3 at right angles to the travelling direction of the carriage 2. The manner of connection of the disk 10 to the table 3 is not limited to the one described above, but the disk 10 may be stationarily connected to the table 3.

When the disk 10 is connected to the table 3 at two points by means of the two pins 12, 12 paralleling with the travelling direction of the carriage 2, as described above, it is desirable to provide two rubber cushions 17, 17 between the disk 10 and the the table 3, as shown in FIG. 3. The two rubber cusions 17, 17 are arranged on the both sides of the center of the disk 10 relative to the travelling direction of the carriage 2, and are fixed to the upper surface of the disk 10. The table 3 is thus tiltable at right angles to the travelling direction of the carriage 2 within a range of elasticity of the two cushions 17, 17. The two rubber cusions 17, 17 may be fixed to the lower surface of the table 3.

As shown in FIGS. 2 and 4, the apparatus of the present invention has a disk rotation limiting mechanism which comprises a projection 19 provided at a prescribed position on the circumferential surface of the disk 10 and a pair of stoppers 20, 20 fixed to the outer surface of the outer cylinder 8 with the projection 19 therebetween at a prescribed distance. Each of the pair of stoppers 20, 20 has a spring 21, and the pair of stoppers 20, 20 elastically squeeze the projection 19 therebetween through the springs 21, 21. Accordingly, the disk 10 is rotatable within a range of the prescribed distance between the pair of stoppers 20, 20.

According to the above-mentioned apparatus of the present invention, even when the pallet 4 mounted with the cargo is placed on the tables 3, 3 of the two carriages 2, 2' at a drift angle to the travelling direction thereof, it is possible to easily correct the position of the pallet 4 on the tables 3, 3 to form right angles to the travelling direction of the two carriages 2, 2' without causing breakage thereof, by altering the relative positions of the two carriages 2, 2' in the travelling direction thereof during travel of the two carriages 2, 2'.

As a result, the pallet 4 can be placed at a prescribed stowage position on the pallet stands 5 at right angles to the longitudinal direction thereof. It is therefore possible to efficiently stow a plurality of pallets 4 at the prescribed stowage position on the pallet stands 5. In addition, it is possible to certainly secure the pallet 4 to a securing fitting provided at the prescribed stowage position on the pallet stands 5 by means of a rope or the like.

According to the apparatus of the present invention, even when a difference in the travelling speed between the two carriages 2, 2', on the tables 3, 3 of which the pallet 4 is placed, produces a difference in the relative position of the two carriages 2, 2' in the travelling direction thereof, torsion or other excessive stress never acts on the two carriages 2, 2' since the tables 3, 3 placed with the pallet 4 are rotatable in a horizontal plane, and therefore, breakage never occurs in the two carriages 2, 2'.

Furthermore, when the disk 10 fixed to the upper end of the inner cylinder 13 is connected to the table 3 at two points by means of the two pins 12, 12 paralleling with the travelling direction of the carriages 2, 2' to make the tables 3, 3 tiltable at right angles to the travelling direction of the carriages 2, 2', a considerably heavy cargo 6 mounted on the pallet 4 never results in breakage of the tables 3, 3, which may be caused by partial concentration of the load on the tables 3, 3.

Figure 5:
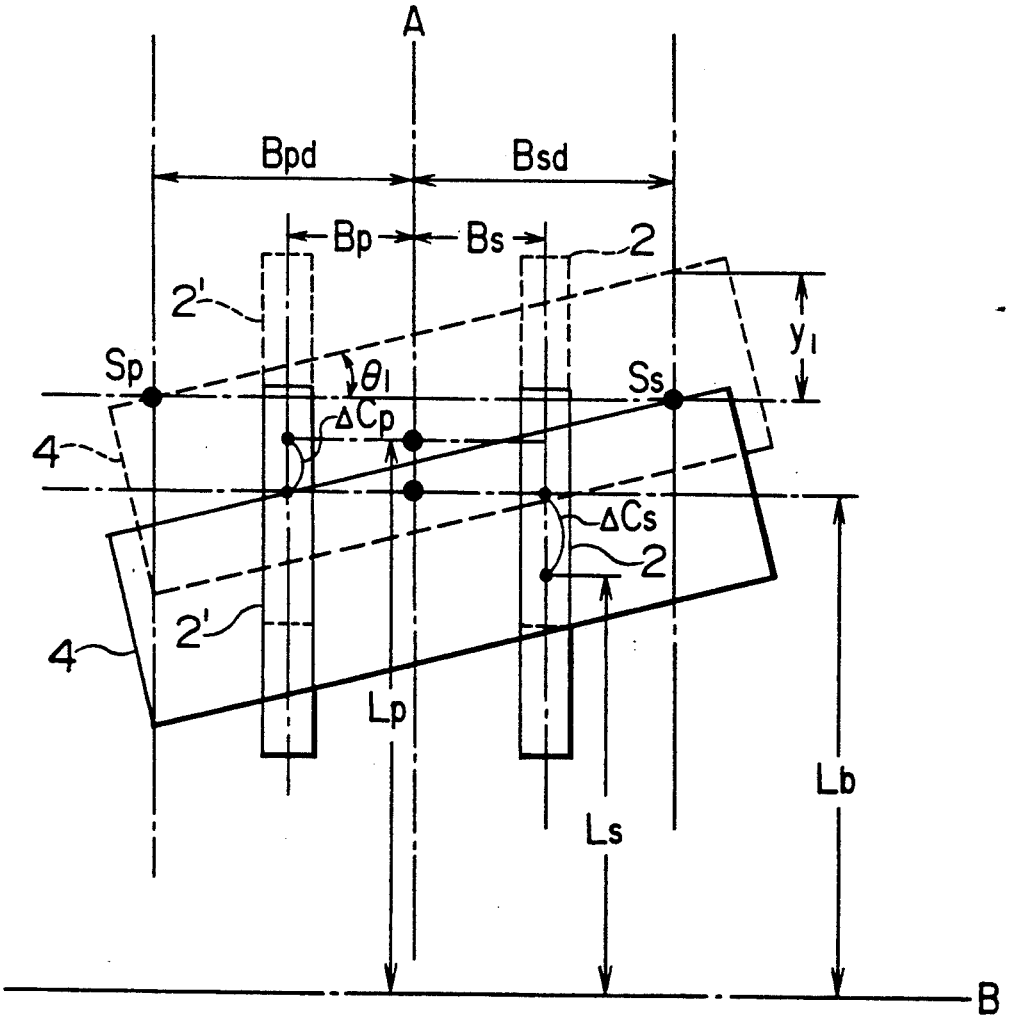
FIG. 5 is a schematic plan view illustrating a typical control mechanism of a driving motor for the carriage of the apparatus of the present invention, which corrects a relative position of the two carriages so that the pallet placed on the tables of the two carriages at a drift angle to the travelling direction thereof, is positioned at right angles to the travelling direction of the two carriages.
Figure 6:
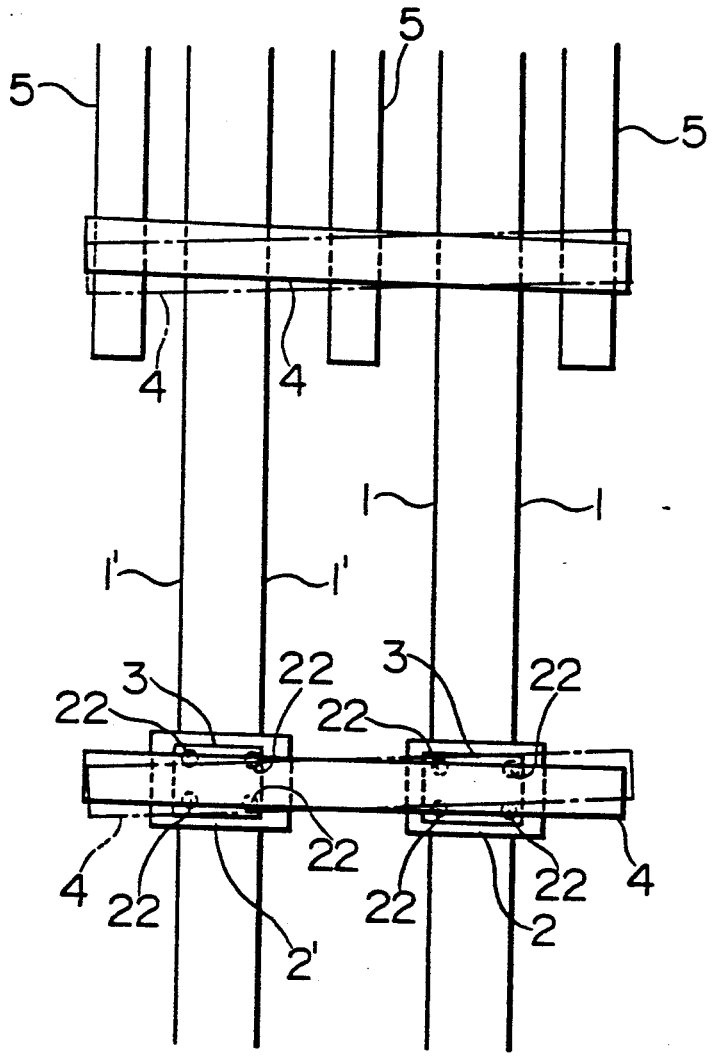
FIG. 6 is a schematic plan view illustrating a typical apparatus of the prior art.

FIG. 5 is a schematic plan view illustrating a typical control mechanism of a driving motor for the carriage of the apparatus of the present invention, which corrects a relative position of the two carriages so that the pallet placed on the tables of the two carriages at a drift angle to the travelling direction thereof, is positioned at right angle to the travelling direction of the two carriages. In FIG. 5, 2 represents a right-hand carriage in the drawing travelling toward a prescribed stowage position on at least two rows of pallet stands (not shown); 2' represents a left-hand carriage in the drawing travelling in synchronization with the right-hand carriage toward the prescribed stowage position on the at least two rows of pallet stands; and 4 represents a pallet placed on over both of the tables (not shown) of the two carriages (2, 2'). In FIG. 5, "A" represents the center line of a freight vessel; and "b" represents a starting point of travel of the carriages 2, 2'.

In FIG. 5, Ss and Sp are sensors for detecting positions of the both ends of the pallet 4 in the longitudinal direction thereof, and thus determining a drift angles of the pallet 4 to the travelling direction of the two carriages 2, 2'. The sensor Ss, which is the right-hand one in the drawing, detects a position of the right end of the pallet 4 in the longitudinal direction thereof. The sensor Sp, which is the left-hand one in the drawing, detects a position of the left end of the pallet 4 in the longitudinal direction thereof.

The sensors Ss and Sp are arranged symmetrically relative to the center line A of the fright vessel at positions at a certain distances from the starting point of travel B of the two carriages 2, 2' travelling toward a prescribed stowage position on the pallet stands (not shown). In FIG. 5, Bsd represents the distance between the center line A of the fright vessel and the right-hand sensor Ss; Bpd represents the distance between the center line A of the freight vessel and the left-hand sensor Sp; Bs represents the distance between the center line A of the freight vessel and the center line of the right-hand carriage 2; and Bp represents the distance between the center line A of the freight vessel and the center line of the left-hand carriage 2'.

As shown in FIG. 5, the pallet 4 is placed on the tables (not shown) of the two carriages 4, 4' at a drift angle to the travelling direction thereof, in a state in which the right end of the pallet 4 in the longitudinal direction thereof precedes the left end of the pallet, relative to the travelling direction of the two carriages 4, 4'. The two carriages 2, 2', on which the pallet 4 is placed at a drift angle as described above, travel in synchronization with each other from the starting point of travel B toward the prescribed stowage position on the pallet stands (not shown).

As a result, as indicated by the solid line in FIG. 5, the position of the right end of the pallet 4 in the longitudinal direction thereof is first detected by the right-hand sensor Ss. Then, as indicated by the dotted line, the position of the left end of the pallet 4 in the longitudinal direction thereof is detected by the left-hand sensor Sp.

A distance of travel of the right-hand carriage 2 from the starting point of travel B, at the moment when the position of the right end of the pallet 4 in the longitudinal direction thereof has been detected by the right-hand sensor Ss, is assumed to be Ls, and a distance of travel of the left-hand carriage 2' from the starting point of travel B, at the moment when the position of the left end of the pallet 4 in the longitudinal direction thereof has been detected by the left-hand sensor Sp, is assumed to be Lp. On the other hand, a distance of travel of the right-hand and the left-hand carriages 2, 2' from the starting point of travel B, at the moment when the positions of the both ends in the longitudinal direction of the pallet 4 placed on the tables (not shown) of the two carriages 2, 2' at right angles to the travelling direction thereof has simultaneously been detected by the right-hand and the left-hand sensors Ss and Sp, is assumed to be Lb.

An amount of correction ΔCs of the position of the right-hand carriage 2 for correcting the position of the pallet 4 to form right angles to the travelling direction of the two carriages 2, 2', is calculable in accordance with the following equation (1), and an amount of correction ΔCp of the position of the left-hand carriage 2', is calculable in accordance with the following equation (2):

$$\Delta Cs = Lb - Ls \quad (1)$$

$$\Delta Cp = Lp - Lb \quad (2)$$

The distance $y_1$ between the position of the right end of the pallet 4 in the longitudinal direction thereof and the right-hand sensor Ss, at the moment when the position of the left end of the pallet 4 in the longitudinal direction thereof has been detected by the left-hand sensor Sp, is calculable in accordance with the following equation (3), and the degree of drift angle $\theta_1$ of the pallet 4 is calculable in accordance with the following equation (4) on the basis of the thus calculated distance $y_1$:

$$y_1 = \Delta Cs + \Delta Cp = Lp - Ls \quad (3)$$

$$\tan\theta_1 = \frac{y_1}{Bpd + Bsd} \quad (4)$$

The right-hand carriage 2 is retreated by an amount X calculated in accordance with the following equations (5) and (6) so that the degree of drift angle $\theta_1$ of the pallet 4 calculated in accordance with the equation (4)

above, and the left-hand carriage 2' is advanced by the same amount X:

$$\frac{X}{Bs} = \frac{y_1}{Bpd + Bsd} \quad (5)$$

$$X = \frac{y_1}{Bpd + Bsd} \cdot Bs \quad (6)$$

As a result, the position of the pallet 4 placed on the tables (not shown) of the two carriages 2, 2' is corrected to form right angles to the travelling direction of the two carriages 2, 2'. Alternatively, any one of the right-hand carriage 2 and the left-hand carriage 2' may be retreated or advanced by the amount 2×.

According to the present invention, as described above in detail, it is possible to provide an apparatus which, when stowing a pallet mounted with a cargo into a hold of a freight vessel by means of two carriages, permits to place the pallet at a prescribed stowage position on the pallet stands at right angles to the longitudinal direction thereof so as to efficiently stow a plurality of pallets at the prescribed stowage position on the pallet stands, even if the pallet is placed on the tables of the two carriages at a drift angle to the travelling direction thereof, and furthermore, prevents breakage of the two carriages caused by torsion or other excessive stress acting on the two carriages, even if a difference is produced in a relative position of the two carriages in the travelling direction thereof, thus providing many industrially useful effects.

What is claimed is:

1. An apparatus for stowing a pallet mounted with a cargo into a hold of a freight vessel, which comprises:
   - two pairs of rails (1, 1') installed on a floor of a hold of a freight vessel symmetrically relative to the center line of said freight vessel and in parallel with said center line;
   - at least two rows of pallet stands (5), for placing a pallet (4) mounted with a cargo, provided at least outside each of said two pairs of rails (1, 1') and in parallel therewith;
   - two carriages (2, 2') travellable on said two pairs of rails (1, 1') in synchronization with each other, said two carriages (2, 2') being arranged each on each of said two pairs of rails (1, 1');
   - vertically movable table (3) provided on each of said two carriages (2, 2'); and
   - a lifting mechanism of said table (3), provided on each of said two carriages (2, 2'), said lifting mechanism comprising an outer cylinder (8) fixed vertically on each of said carriages (2, 2'), an inner cylinder (13) slidably engaging in said outer cylinder (8), a disk (10) fixed to the upper end of said inner cylinder (13), said disk (10) being connected to said table (3), and a hydraulic means (9) comprising a cylinder (9*a*) pin-connected vertically to each of said carriages (2, 2') and a rod (9*b*) engaging in said cylinder (9*a*), the upper end of said rod (9*b*) of said hydraulic means (9) being pin-connected to the center of the lower surface of said disk (10), whereby said table (3) is vertically movable by means of said hydraulic means (9) and rotatable in a horizontal plane.

2. An apparatus as claimed in claim 1, wherein:
   - said disk (10) is connected to said table (3) at two points by means of two pins (12, 12) paralleling with the travelling direction of said two carriages (2, 2'), whereby said table (3) is tiltable at right angles to the travelling direction of said two carriages (2, 2').

3. An apparatus as claimed in claim 2, wherein:
   - said apparatus has two rubber cushions (17, 17) between said disk (10) and said table (3);
   - said two rubber cushions (17, 17) are arranged on the both sides of the center of said disk (10) relative to the travelling direction of said two carriages (2, 2'); and
   - said two rubber cushions (17, 17) are fixed to the upper surface of said disk (10) or to the lower surface of said table (3);
   - whereby said table (3) is tiltable at right angles to the travelling direction of said two carriages (2, 2') within a range of elasticity of said two rubber cushions (17, 17).

4. An apparatus as claimed in claim 3, wherein:
   - said apparatus has a disk rotation limiting mechanism comprising a projection (19) provided at a prescribed position on the circumferential surface of said disk (10), and a pair of stoppers (20, 20) fixed to the outer surface of said outer cylinder (8) with said projection (19) therebetween at a prescribed distance, whereby said disk (10) is rotatable within a range of said prescribed distance.

5. An apparatus as claimed in claim 3, wherein:
   - said apparatus has two sensors (Ss, Sp) for detecting positions of the both ends in the longitudinal direction of said pallet (4) placed on over both of said tables (3, 3) of said two carriages (2, 2'), so as to determine a drift angle of said pallet (4) to the travelling direction of said two carriages (2, 2'), and said two sensors (Ss, Sp) are arranged symmetrically relative to the center line of said freight vessel, at positions at a certain distance from a starting point of travel of said two carriages (2, 2') traveling toward a prescribed stowage position on said at least two rows of pallet stands (5).

6. An apparatus as claimed in claim 2, wherein:
   - said apparatus has a disk rotation limiting mechanism comprising a projection (19) provided at a prescribed position o the circumferential surface of said disk (10), and a pair of stoppers (20, 20) fixed to the outer surface of said outer cylinder (8) with said projection (19) therebetween at a prescribed distance, whereby said disk (10) is rotatable within a range of said prescribed distance.

7. An apparatus as claimed in claim 2, wherein:
   - said apparatus has two sensors (Ss, Sp) for detecting positions of the both ends in the longitudinal direction of said pallet (4) placed on over both of said tables (3, 3) of said two carriages (2, 2'), so as to determine a drift angle of said pallet (4) to the travelling direction of said two carriages (2, 2'), and said two sensors (Ss, Sp) are arranged symmetrically relative to the center line of said freight vessel, at positions at a certain distance from a starting point of travel of said two carriages (2, 2') travelling toward a prescribed stowage position on said at least two rows of pallet stands (5).

8. An apparatus as claimed in claim 1 wherein:
   - said apparatus has a disk rotation limiting mechanism comprising a projection (19) provided at a prescribed position on the circumferential surface of said disk (10), and a pair of stoppers (20, 20) fixed to the outer surface of said outer cylinder (8) with said projection (19) therebetween at a prescribed distance, whereby said disk (10) is rotatable within a range of said prescribed distance.

9. An apparatus as claimed in claim 8, wherein:

said apparatus has two sensors (Ss, Sp) for detecting positions of the both ends in the longitudinal direction of said pallet (4) placed on over both of said tables (3, 3) of said two carriages (2, 2'), so as to determine a drift angle of said pallet (4) to the travelling direction of said two carriages (2, 2'), and said two sensors (Ss, Sp) are arranged symmetrically relative to the center line of said freight vessel, at positions at a certain distance from a starting point of travel of said two carriages (2, 2') travelling toward a prescribed stowage position on said at least two rows of pallet stands (5).

10. An apparatus as claimed in claim 1, wherein:

said apparatus has two sensors (Ss, Sp) for detecting positions of the both ends in the longitudinal direction of said pallet (4) placed on over both of said tables (3, 3) of said two carriages (2, 2'), so as to determine a drift angle of said pallet (4) to the travelling direction of said two carriages (2, 2'), and said two sensors (Ss, Sp) are arranged symmetrically relative to the center line of said freight vessel, at positions at a certain distance from a starting point of travel of said two carriages (2, 2') travelling toward a prescribed stowage position on said at least two rows of pallet stands (5).

* * * * *